US006761531B2

(12) United States Patent
Toye

(10) Patent No.: US 6,761,531 B2
(45) Date of Patent: Jul. 13, 2004

(54) SPA PUMPING METHOD AND APPARATUS

(75) Inventor: Reginald Toye, Surrey (CA)

(73) Assignee: Pacific Northwest Tooling, Surrey (CA)

( * ) Notice: Subject to any disclaimer, the term of this patent is extended or adjusted under 35 U.S.C. 154(b) by 0 days.

(21) Appl. No.: 10/072,628

(22) Filed: Feb. 8, 2002

(65) Prior Publication Data

US 2002/0141889 A1 Oct. 3, 2002

Related U.S. Application Data

(63) Continuation-in-part of application No. 09/397,485, filed on Sep. 16, 1999, now Pat. No. 6,428,783.

(51) Int. Cl.[7] ..... F04D 29/42

(52) U.S. Cl. ..... 415/203; 415/204; 415/206; 4/492

(58) Field of Search ..... 415/203, 204–205, 415/206–207; 4/492, 509

(56) References Cited

U.S. PATENT DOCUMENTS

| | | | | |
|---|---|---|---|---|
| 1,095,394 A | * | 5/1914 | Goldman | 415/97 |
| 2,710,580 A | * | 6/1955 | Holzwarth | 416/186 R |
| 3,707,335 A | * | 12/1972 | Barnard | 415/204 |
| 4,853,987 A | * | 8/1989 | Jaworski | 4/541.6 |
| 4,858,255 A | | 8/1989 | Haisman | |
| 5,404,598 A | | 4/1995 | Hadsell | |
| 5,647,736 A | | 7/1997 | French | |
| 5,807,289 A | | 9/1998 | Camp | |
| 5,893,180 A | | 4/1999 | Moreland | |
| 6,030,180 A | | 2/2000 | Clarey | |
| 6,065,161 A | | 5/2000 | Mateina | |

FOREIGN PATENT DOCUMENTS

DE 3812519 C1 5/1989

* cited by examiner

*Primary Examiner*—Edward K. Look
*Assistant Examiner*—Igor Kershteyn
(74) *Attorney, Agent, or Firm*—John Russell Uren

(57) ABSTRACT

A water pump for a spa or the like has a pump water inlet, a pump water outlet and an impeller driving water from said inlet to said outlet. The impeller provides the water axially introduced at the pump water inlet with a radial component which delivers the water to a large plenum chamber surrounding the impeller and which plenum chamber has an increasing cross sectional area as the water moves from the pump water inlet to a plenum chamber outlet thereby reducing backpressure in the water. The plenum chamber terminates with the plenum water outlet located closely to the impeller and a smooth transition area defines the area extending from the plenum chamber outlet to the pump water outlet. The water outlet preferably extends so that the water has a directional component which is generally parallel to the direction of the water entering the pump through the pump water inlet.

10 Claims, 9 Drawing Sheets

SPA PUMPING METHOD AND APPARATUS

CROSS-REFERENCE TO RELATED APPLICATION

This application is a continuation-in-part of application Ser. No. 09/397,485 filed Sep. 16, 1999 now U.S. Pat. No. 6,428,783.

INTRODUCTION

This invention relates to spas or hot tubs and, more particularly, to a pump allowing large volumes of water to have directional changes close to the pump impeller, the pump providing water under pressure to the spa jets.

BACKGROUND OF THE INVENTION

The use of pumps in spas or hot tubs is, of course, known. Such pumps are used to take water from a water inlet, put the water under pressure and convey the water under such pressure to the various outlets or jets within the tub where the user is positioned. The water under pressure creates a flow within the tub and otherwise discharges on the user where it has a pleasant and therapeutic benefit.

The pumps that create the pressure, however, are typically centripetal type pumps. These pumps have an impeller with a central portion into which water from the water inlet is introduced. The impeller has a series of radially located vanes that convey the water from the central inlet area and exhaust it radially to an outlet located adjacent the radial vanes. While the centripetal type pumps are pervasive in the industry, they have disadvantages.

A first disadvantage is that the water volume supplied under pressure by the centripetal type pump is limited. This dictates the size of jets that can be used in order to impinge properly upon a user and create the currents within the tub. Second, with the use of a centripetal type pump, the operation is typically at the upper end of the volume capabilities of he pump. This causes unnecessarily high pump noise which is diversionary to the enjoyment of a spa user. Thirdly, since the volume of water being pumped is limited, the jets may be somewhat slower in acting than would otherwise be desirable.

U.S. Pat. No. 5,647,736 (French) teaches a motor cooling technique typically used in present spas. French takes ambient air from within a component compartment of a spa and passes such air through the motor which powers the spa pump by the use of the usual cooling fan within the motor. French teaches collecting the hot air which has passed through the motor by an exhaust shroud and exhausting such air to ambient conditions outside the component compartment of the spa.

While, again, the French technique operates generally in a satisfactory manner, advantages in such a cooling technique and increased flexibility with the cooling air is possible. First, because French takes his cooling air from within the component compartment, the location of electrical and electronic components within the compartment necessarily generates heat and, accordingly, the air gathered from the component compartment is at an elevated temperature which limits the cooling of the motor otherwise obtainable with air at a lower temperature.

Second, by exhausting his collected and heated air to a location outside the spa, the thermal energy of the heated air is wasted. The thermal energy, particularly in a spa, could be harnessed for other uses.

Thirdly, French does not cool the pump which is driven by the motor. His air is introduced into the cooling air inlet of the motor and does not reduce the temperature of the pump. Cooling the pump would assist is more efficient operation of both the pump and the motor.

Fourthly, centripetal type pumps typically do not have wide operating environment capabilities. They are prone to overheating if used in adverse conditions such as high altitude, low humidity, high ambient temperature conditions. Likewise, if the ventilation surrounding the pump is poor under the skirt of the spa for example, this also contributes to such problems.

SUMMARY OF THE INVENTION

According to one aspect of the invention, there is provided a spa having water jets used to discharge water which impinges upon a user, said spa comprising a pump having a pump water inlet with a pump water inlet axis, a pump water outlet operably connected to said water inlet and allowing water under pressure to pass from said pump water inlet to said pump water outlet, an axially rotating impeller and a relatively large plenum chamber located outside said impeller and having a plenum chamber outlet operably connected to said pump water outlet, said impeller propelling water outwardly of said impeller into said plenum chamber with a principal direction of movement of said water being radially outwardly from said pump water inlet axis to said plenum chamber, said plenum chamber being defined by a passageway having a generally concave inner and curved rearward surface and a variable cross sectional area, said cross-sectional area increasing as said water from said impeller moves around and within said plenum chamber from a position nearer said pump water inlet to a position further from said pump water inlet and closer to said plenum chamber outlet, said plenum chamber outlet being located at a radial position furthermost from said water inlet and allowing said water to move from said plenum chamber outlet to said pump water outlet, and thence to said water jets.

According to a further aspect of the invention, there is provided a method of providing water to the jets of a spa comprising introducing water along an axis to a pump water inlet of a pump, using an impeller to propel said introduced water from said pump water inlet in a generally radial direction to a plenum chamber surrounding said impeller while simultaneously providing said water with a velocity component within said plenum chamber from said pump water inlet to a plenum water outlet while the cross-sectional area of said plenum chamber increases from said pump water inlet to said plenum water outlet and smoothly transitioning said water from said plenum water outlet to a pump water outlet by the use of a smooth curved surface between said plenum water outlet and said pump water outlet.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 1:
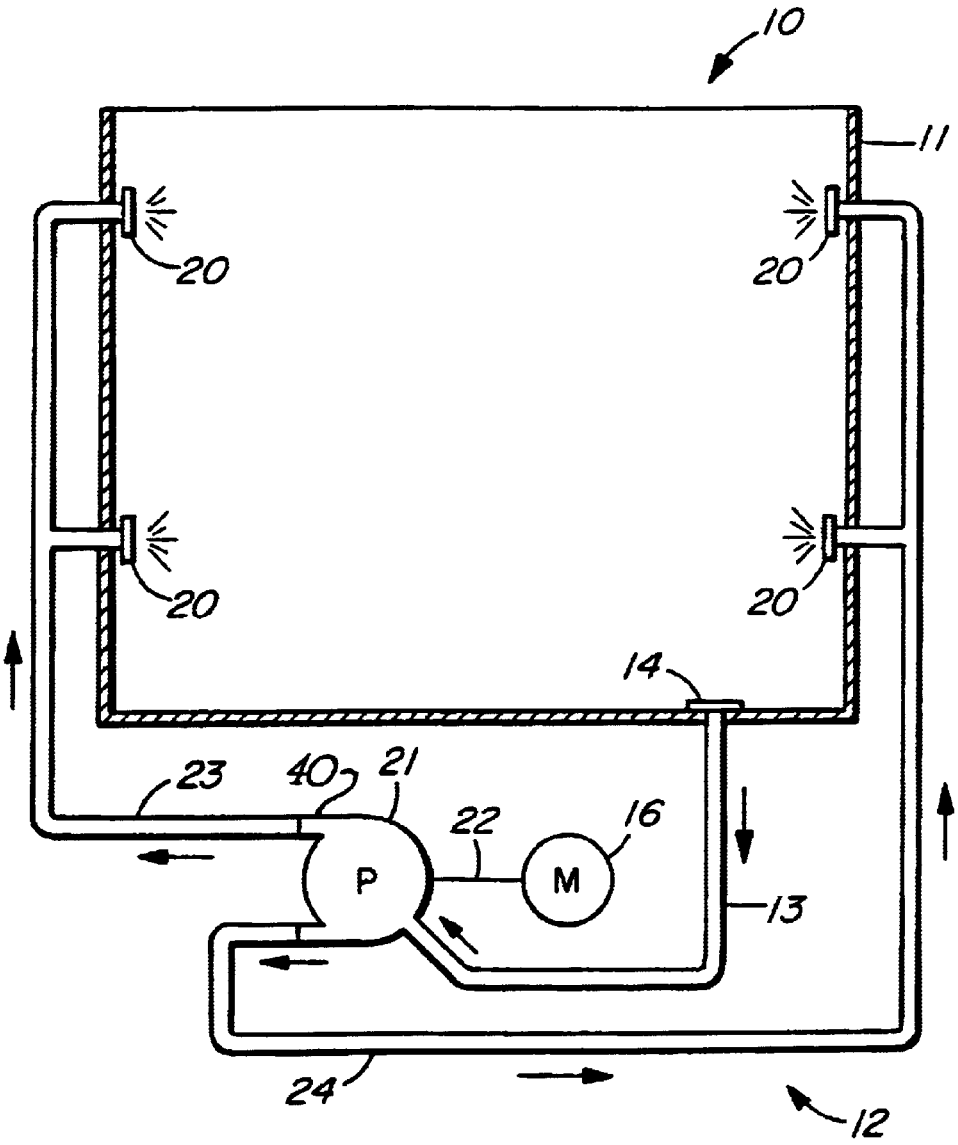
FIG. 1 is a diagrammatic illustration in plan showing the motor and pump of a spa according to a first embodiment of the present invention.
Figure 2:
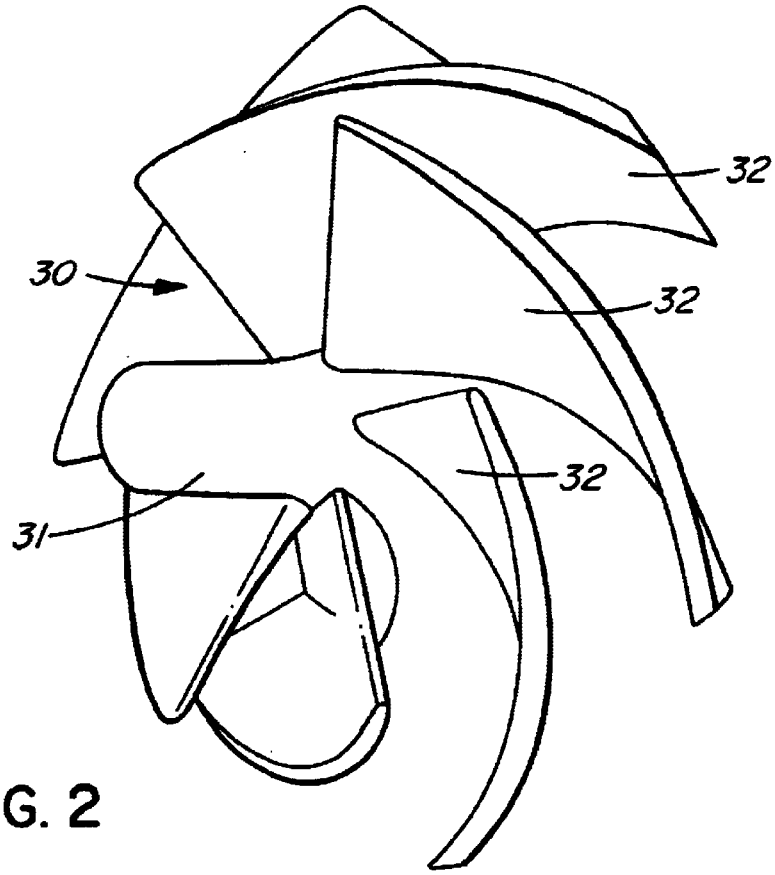
FIG. 2 is a diagrammatic isometric view of the impeller used in the turbine pump according to the invention particularly illustrating the hub and blade surfaces.

Referring now to the drawings, a spa or hot tub is generally illustrated at 10 in FIG. 1. The spa 10 includes a tub 11 for holding water into which a user is immersed and a water circulation system generally illustrated at 12.

The water circulation system includes a water inlet pipe 13 which is generally attached to an inlet grill 14 located under the surface of the water in the tub 11 such that the water within the spa 10 is constantly recirculated from the grill 14 to the water jets 20, which jets 20 are likewise located within the tub 11 and under the water surface. Jets 20 are used to create currents within the tub 11 and to provide water under pressure to the body of a user as desired by the user and as, of course, is known.

The water circulation system 12 further comprises a motor 16 used for driving a pump 21 by way of shaft 22. The pump 21 is a turbine pump as will be described in greater detail. Two outlet pipes 23, 24 extend from the turbine pump 21 and are each connected to a proportionate number of jets 20. According to FIG. 1, each of the outlet pipes 23, 24 is connected to two(2) jets 20.

The turbine pump 21 includes an impeller generally illustrated at 30 with a plurality of blades 32 located about the periphery of the impeller 30. One of the blades 32 is illustrated diagrammatically in FIG. 4. The impeller 30 further comprises a hub 31 which rotates together with the blades 32 by way of shaft 22 which is connected to motor 20 (FIG. 1) as has been described.

Figure 4:
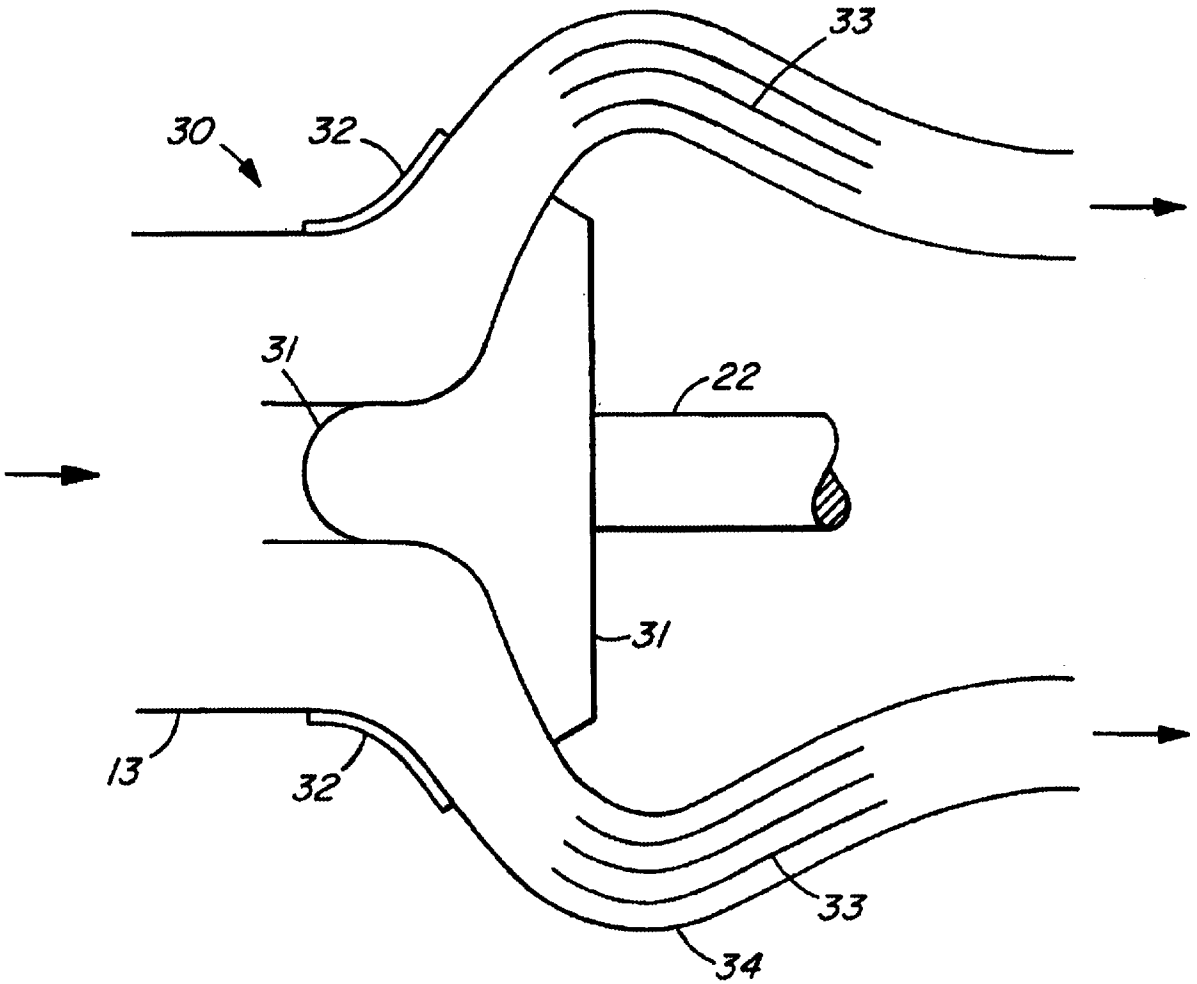
FIG. 4 is a diagrammatic view in cutaway and illustrating the hub and one impeller vane of the turbine pump and further illustrating deswirl vanes located downstream of the pump impeller.

Deswirl vanes 33 are diagrammatically illustrated in FIG. 4. The deswirl vanes 33 are located downstream of the impeller 30. Deswirl vanes 33 bring the water in water pathways 34 radially inwardly and connect the water pathways 34 to an axial outflow pipe 40 (FIG. 1). Axial outflow pipe 40 is diverted into two (2) outlet pipes 23, 24 which extend to jets 20 as described.

Operation

Figure 3:
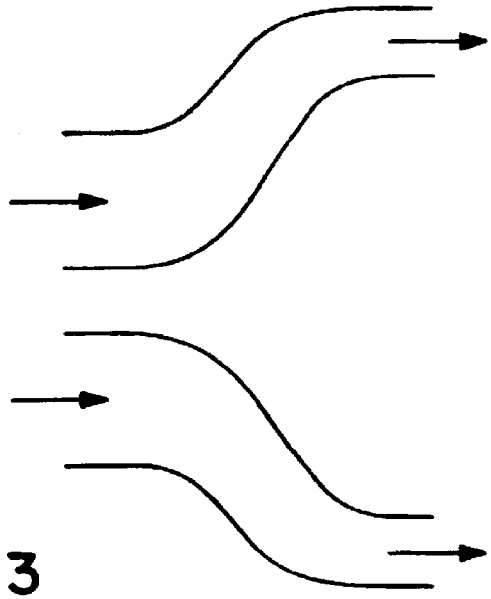
FIG. 3 is a diagrammatic isometric view of the flow path downstream from the turbine blades, also known as a "meridional" view.

In operation, the spa 10 will be filed with water as is known and the operation of the motor 20 will be initiated by turning a switch on or otherwise commencing its operation. Shaft 22 will commence to turn impeller 30 (FIG. 3) and hub 31 with blades 32 attached thereto. Water coming from the inlet pipe 13 will be put under pressure and propelled by the blades 32 to water pathways 34 connected to the downstream side of impeller 30. The deswirl vanes 33 will allow removal of turbulence and smoothly pass the water to outlet pipe 40 where it then is diverted to outlet pipes 23, 24 and passes to the jets 20. The water exiting from jets 20 will pass to the tub 11 where it creates currents in the tub 11 and, if desired, is directed by the jets 20 onto a user.

Figure 5:
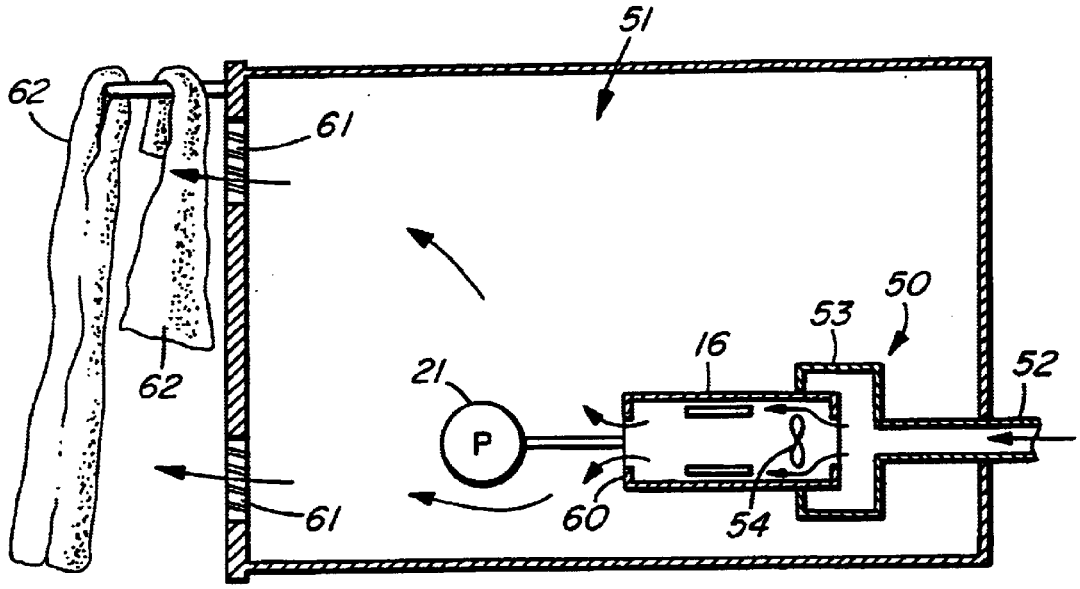
FIG. 5 is a diagrammatic side view of the cooling air system used for motor and pump cooling according to a further aspect of the invention.
Figure 6:
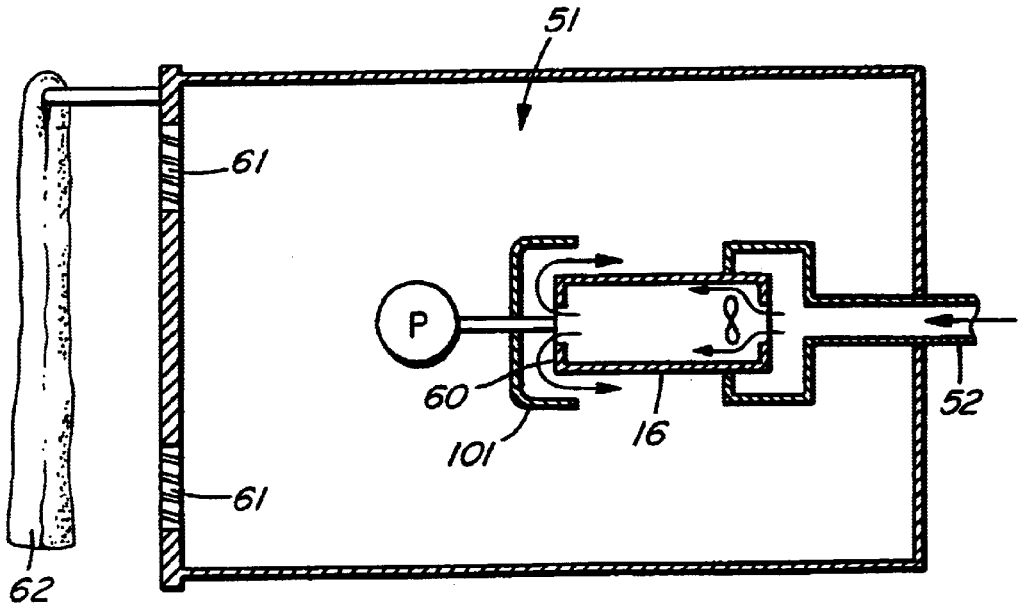
FIG. 6 is a more detailed view of the cooling air system used for the motor and pump cooling of FIG. 5.

The cooling system for the motor 16 driving pump 21 is generally illustrated at 50 in FIG. 5. The pump 21 and motor 20 are each located within the component compartment generally illustrated at 51. Component compartment 51 includes most of the operating components of the spa 10 and particularly includes the electrical and electronic components such as motor 20, solenoids (not shown), logic components (not shown), all of which generate heat during operation. The component compartment 51 is conveniently sealed, as will be described, with the exception of the exit vents so that air introduced into the component compartment 51 may be directed as desired.

An air inlet pipe 52 allows air to be obtained from the ambient surroundings where the spa 10 is located. It will be appreciated that spas 10 are typically used more often when the ambient air is considerably cooler than the water temperature of the spa 10. Generally, therefore, the ambient air will be relatively cool compared to the temperature of the air within the cooling compartment 51.

The ambient air enters air inlet pipe 52 and passes to a shroud 53 connected to motor 20. A fan 54 takes air from the air inlet pipe 52 and passes it over the windings within the motor 20. Since the windings of motor 20 are generating heat, the air will be heated as it flows from the downstream end of motor 20 to the upstream end 60. The heated air leaves the upstream end of motor 20 and is passed over pump 21 by ducting or otherwise where it further assists in cooling the pump 21.

Two (2) air exit grills 61 are positioned on the outside of the component compartment 51 in a location convenient for hanging towels 62, bathing suits (not shown) and the like. The heated air from the component compartment will warm the towels 62 with the use of the thermal energy carried by the heated air and will then pass to the ambient surroundings.

In preliminary design models of the turbine pump 21, calculations show that an impeller 30 having six (6) blades would be satisfactory. An energy requirement to drive the pump 21 of approximately 2600 watts would produce a volume flow of approximately 400 gallons per minute under load which would require approximately 15 amps at 220 volts. The head or pressure rise of the water through the pump 21 is calculated to be approximately thirteen (13) psi. The use of the deswirl vanes 33 (FIG. 4) has yet to be completed and, indeed, calculations relating to the final design of the deswirl vanes 33 have not yet commenced. It is to be emphasized that the final design of the apparatus has not yet been completed and that the specifications given above are for the purpose of full disclosure at the date this application is filed only and that subsequent design specifications will undoubtedly change under operating conditions with an actual prototype apparatuses being used.

A further embodiment of a pump found useful is illustrated and described in FIGS. 7–10. The pump generally illustrated at 200 (FIG. 7) has a relatively large plenum chamber 210 and which pump 200 is simply appropriately inserted into the water circulation circuit shown in FIG. 1 in place of turbine pump 21 with the necessary changes to the outlet pipes 23, 24 illustrated in that figure. Pump 200 includes a pump water inlet generally illustrated at 201 having a pump water inlet axis 202. An impeller 205 (see also FIG. 9) rotates about axis 202 and radially outwardly directed vanes 206 serve to move the water introduced at the pump water inlet 201 generally radially outwardly to the plenum chamber 210. The plenum chamber 210 increases in cross-sectional area as the water moves from the pump water inlet 201 to the plenum chamber outlet 211 (see also FIG. 9) which plenum chamber outlet 211 lead to a pump water outlet 203 with a pump water outlet axis 204 which is generally is parallel to the pump water inlet axis 202.

Figure 7:
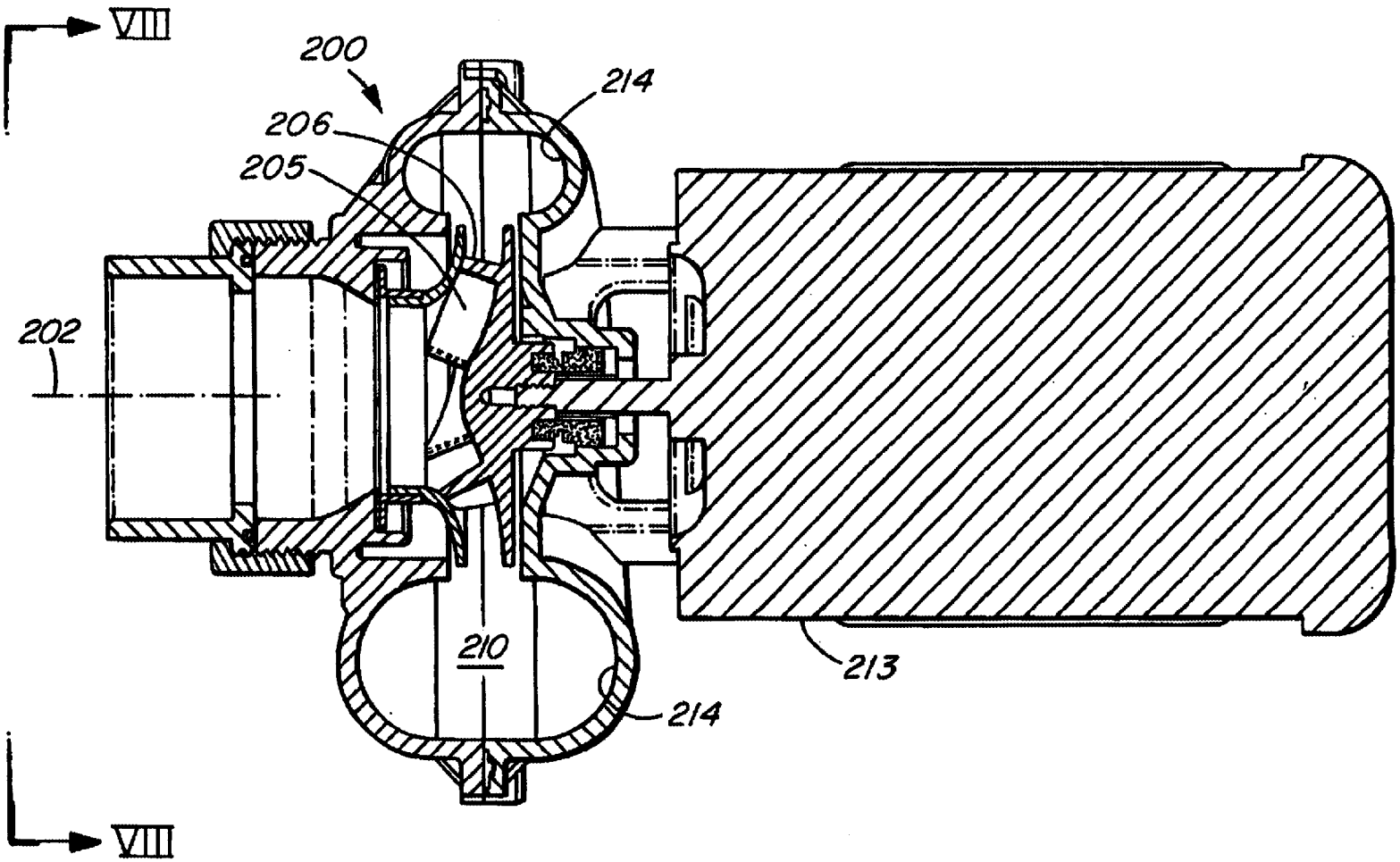
FIG. 7 is a diagrammatic cross-sectional view of a pump in a further embodiment of the invention, particularly illustrating the pump water inlet and the increasing cross-sectional area for water flow within the plenum chamber.
Figure 8:
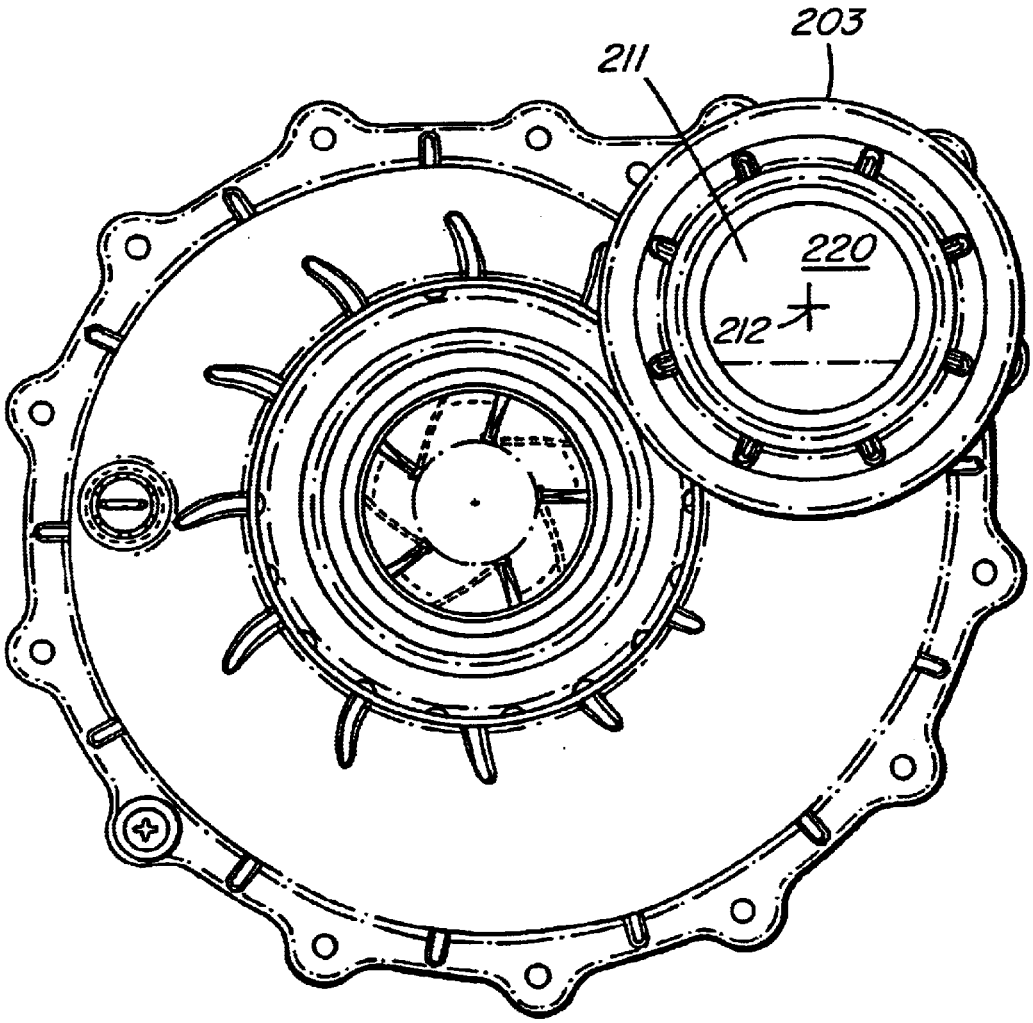
FIG. 8 is a diagrammatic forward view of the pump taken generally along VIII—VIII of FIG. 7.
Figure 9:
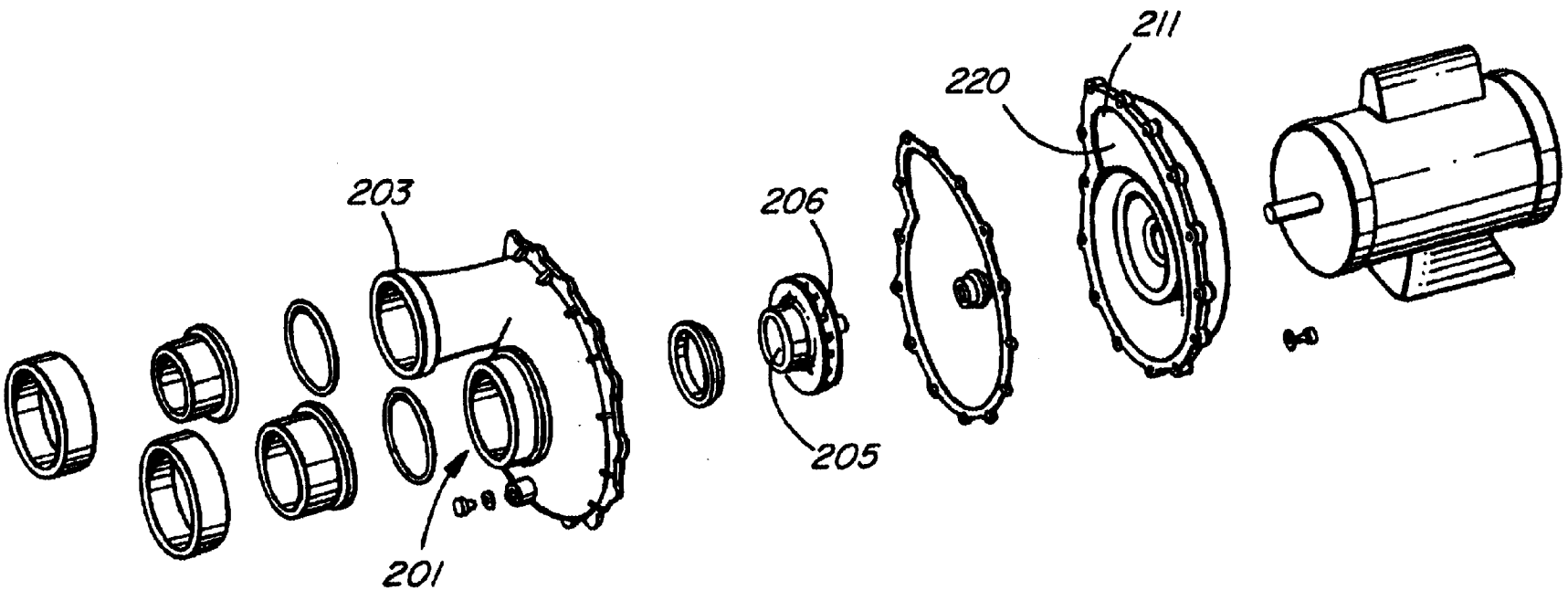
FIG. 9 is a diagrammatic exploded view of the pump according to the pump of FIGS. 7 and 8.

The use of the large plenum chamber 210 has been found particularly useful since the directional change of large quantities of water may be accomplished close to the impeller 205 and the use of the pump water outlet 203 similarly being located close to the impeller 205 and plenum chamber outlet 211 is similarly useful in that space downstream from the pump 200 (i.e., on the right hand side of pump 200 and adjacent the pump motor 213 as seen in FIG. 7) is conserved and the pump motor 213 will generally be of a size which is dictated by its power requirement only and around which ducting for water moving downstream from the pump 200 need not be provided. When large volumes of water are carried by the plenum chamber 210, close to the impeller 205, the pump 200 has been found to move more water with greater efficiency. It is not immediately known why this is so but it is contemplated that since the large volumes of water are closer to the pump 200 due to the large size of the plenum chamber 210, the water volume which is changing its direction of movement and velocity is doing so more quickly adjacent the impeller 205 than at a greater distance thereby increasing the efficiency of water movement.

The plenum chamber 210 has a smoothly curved rearward surface 214 (FIG. 7) which is solid and in the transition area 220 (FIG. 8) from the plenum chamber outlet 211 to the pump water outlet 203, there is likewise provided a smoothly curved surface which enables the direction of the water exiting the plenum chamber 210 to the plenum chamber outlet 211 to be smoothly changed to a direction of water flow directly opposed to the direction of the water flow entering the pump 200 via the pump water inlet 201 along axis 202 in a preferred embodiment. The water exiting from pump water outlet 203 will therefore be moving generally parallel to pump water outlet axis 212.

Figure 10A:
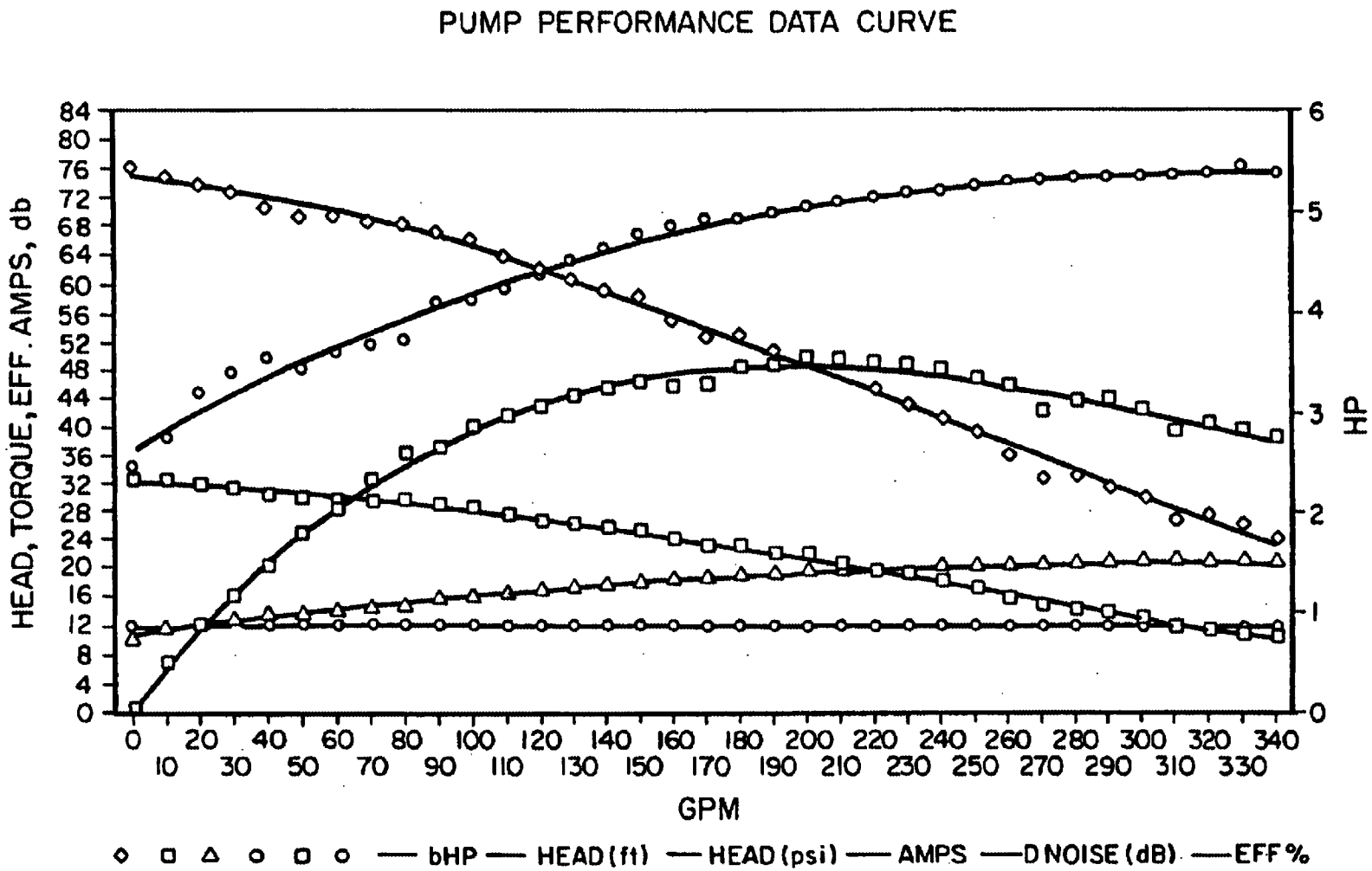
FIGS. 10A and 10B are test performance curves illustrating the water volume passing through the prototype ones of the pump with the same sized motor but different sized impellers.
Figure 10B:
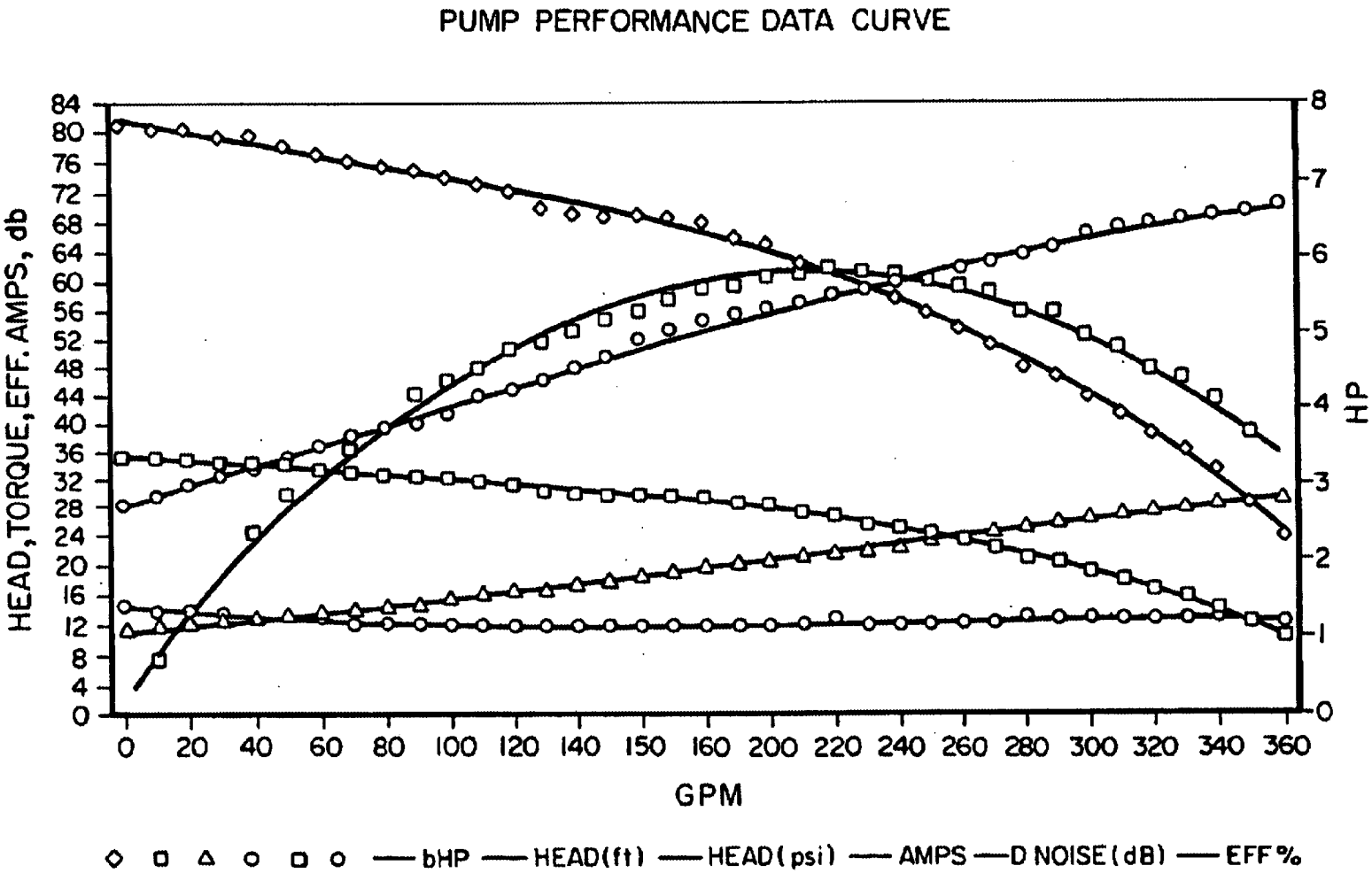

FIGS. 10A and 10B are test results obtained with the pump 200 which pump has two different vane heights for the impeller 205, namely a 0.400 inch vane height in FIG. 10A and a 0.585 inch vane height in FIG. 10B. For example, with a 0.585 vane height on the outside diameter of the impeller, at 200 GPM and a pressure of 28 p.s.i, 20.8 amperes are consumed at 230 VAC and when the pump is being run wide open at 360 GPM, it consumes 29.2 amps.

It is contemplated that the large water volume being located close to the impeller 205 and changing direction quickly and smoothly and having a plenum chamber 210 with an increasing cross sectional area as the water moves from the pump water inlet 201 to the plenum chamber outlet 211 so as to reduce back pressure in the water as the water moves through the plenum chamber 210 would be beneficial regardless of the direction of the pump water outlet 203 and whether or not the water exits from the plenum chamber outlet 210 to the jets in a direction forwardly or rearwardly of the plenum chamber 210 although the forwardly facing exit movement of the water from pump water outlet 203 conserves space that would otherwise be used for the water ducting 23, 24. And of course, if the pump water outlet 203 extended upwardly, gravity would negate at least some of the power advantage according to the invention. But if the change in direction of large quantities of water can be accomplished quickly nearby the impeller 205 and back-pressure is reduced or avoided, larger volumes of water can be moved more efficiently with the pump 200 according to this aspect of the invention.

Many modifications will readily occur to those skilled in the art. For example and while the invention has been described as used in association with spas or hot tubs, it is contemplated that such use would further extend to bathtubs, swimming pools, particularly pools where users swim within a current generated by a water pumping action, and the like.

Many other modifications will arise to those skilled in the art and the specific embodiments herein should be taken as illustrative of the invention only and not as limiting its scope as defined in accordance with the accompanying claims.

I claim:

1. A spa having water jets used to discharge water which impinges upon a user, said spa comprising a pump having a pump water inlet with a pump water inlet axis, a pump water outlet operably connected to said water inlet and allowing water under pressure to pass from said pump water inlet to said pump water outlet, an axially rotating impeller and a relatively large plenum chamber located outside said impeller and having a plenum chamber outlet operably connected to said pump water outlet, said impeller propelling water outwardly of said impeller into said plenum chamber with a principal direction of movement of said water being radially outwardly from said pump water inlet axis to said plenum chamber, said plenum chamber being defined by a passageway having a generally concave inner and curved rearward surface and a variable cross sectional area, said cross-sectional area increasing as said water from said impeller moves around and within said plenum chamber from a position nearer said pump water inlet to a position further from said pump water inlet and closer to said plenum chamber outlet, said plenum chamber outlet being located at a radial position furthermost from said water inlet and allowing said water to move from said plenum chamber outlet to said pump water outlet, and thence to said water jets.

2. A spa as in claim 1 wherein a smoothly curved surface defines a transition area between said plenum chamber and said plenum chamber outlet to said pump water outlet.

3. A spa as in claim 2 wherein said pump water outlet extends in a generally forward direction from said plenum chamber outlet.

4. A spa as in claim 2 wherein said pump water inlet and said pump water outlet have respective axes, said axes being generally parallel in a vertical plane passing through said axes.

5. A spa as in claim 4 wherein said axes of said pump water inlet and said pump water outlet are parallel, said pump water outlet extending in a forward direction and said water entering said pump along said axis of said pump water inlet and exiting said pump along said axis of said pump water outlet.

6. Method of providing water to the jets, of a spa comprising introducing water along an axis to a pump water inlet of a pump, using an impeller to propel said introduced water from said pump water inlet in a generally radial direction to a plenum chamber surrounding said impeller while simultaneously providing said water with a velocity component within said plenum chamber from said pump water inlet to a plenum water outlet while the cross-sectional area of said plenum chamber increases from said pump water inlet to said plenum water outlet and smoothly transitioning said water from said plenum water outlet to a pump water outlet by the use of a smooth curved surface between said plenum water outlet and said pump water outlet.

7. Method as in claim 6 and further providing said water exiting from said pump water outlet with a forward component in a direction opposed to the direction of said water entering said pump water inlet.

8. Method as in claim 7 wherein said water entering said pump water inlet has a first axis centrally located in said introduced water and said water exiting from said pump water outlet has a second axis, said first and second axes being generally parallel.

9. Method as in claim 8 wherein said first and second axes are parallel in respective vertical planes passing through each of said axes.

10. Method as in claim 9 wherein said first and second axes are parallel in respective horizontal planes passing through each of said axes.

* * * * *